United States Patent [19]

Bendickson et al.

[11] Patent Number: 4,825,552

[45] Date of Patent: May 2, 1989

[54] FILLET KNIFE HAVING A FLEXIBLE HANDLE

[75] Inventors: Roy B. Bendickson; Robert A. Seaton, both of Wausau, Wis.

[73] Assignee: Fiskars Oy Ab, Helsinki, Finland

[21] Appl. No.: 219,827

[22] Filed: Jul. 14, 1988

Related U.S. Application Data

[63] Continuation of Ser. No. 22,102, Mar. 5, 1987, abandoned.

[51] Int. Cl.[4] ..... B25G 1/02; B26B 3/00

[52] U.S. Cl. ..... 30/342; 30/356; 30/340; 16/DIG. 12

[58] Field of Search ..... 30/340, 342, 343, 346, 30/356; 16/DIG. 12, DIG. 19; 446/473

[56] References Cited

U.S. PATENT DOCUMENTS

| | | | |
|---|---|---|---|
| 294,558 | 3/1884 | Wingfield | 30/343 |
| 336,314 | 2/1886 | Hatfield | 30/342 |
| 1,418,683 | 6/1922 | Stevens . | |
| 1,728,619 | 9/1929 | Lambert | 30/343 X |
| 1,931,773 | 10/1933 | Sobol | 30/343 X |
| 2,421,339 | 5/1947 | Leger | 30/165 |
| 2,520,355 | 8/1950 | Bell | 30/343 X |
| 3,266,081 | 8/1966 | Heim | 16/110 |
| 3,872,572 | 3/1975 | Hahn | 29/432.1 |
| 4,184,248 | 1/1980 | Wolfe | 30/340 |
| 4,327,465 | 5/1982 | Moritsch | 29/80 |
| 4,330,937 | 5/1982 | Cope | 30/153 |
| 4,452,289 | 6/1984 | Smith | 145/62 |

OTHER PUBLICATIONS

Photocopy of Buck 123 Knife.
Photocopy of 6362 Puma Mariner Knife.

*Primary Examiner*—Frank T. Yost
*Assistant Examiner*—Michael D. Folkerts
*Attorney, Agent, or Firm*—Foley & Lardner

[57] ABSTRACT

A knife according to the invention has a handle with improved flexibility and gripping characteristics. The tang embedded in the unitary handle has a series of spaced-apart flex sites at which the tang can resiliently bend. The handle is made of a resilient material which can flex in cooperation with the tang. The handle may further include a series of rows of flexible ribs as an improved gripping surface. The knife according to the invention can flex along its entire length and is well suited for use as a fillet knife.

15 Claims, 2 Drawing Sheets

FILLET KNIFE HAVING A FLEXIBLE HANDLE

This is a continuation of application Ser. No. 022,102 filed on Mar. 5, 1987, now abandoned, by Roy B. Bendickson and Robert A. Seaton.

FIELD OF THE INVENTION

This invention relates to an improved knife having a flexible handle particularly useful for filleting fish.

BACKGROUND OF THE INVENTION

Fillet knives having flexible blades are well known. Such knives often have a unitary steel blade and a rubber or plastic handle. The blade has an end portion, or tang, embedded in the handle. According to one known design, the tang has one or more holes therein. The handle, when molded around the tang, fills the holes and is thereby mechanically bonded to the tang. The tang also has a series of rounded notches in opposite side edges thereof. The handle material fills these notches and thereby tends to prevent lengthwise disengagement of the blade and handle.

Prior patents suggest a variety of handle designs and means for securing the handle to the tang. For example, it is common practice to secure the handle to the tang by means of rivets or other fasteners inserted through aligned holes in the handle and tang. See, for example, Wolfe U.S. Pat. No. 4,184,248 issued Jan. 22, 1980, Hahn U.S. Pat. No. 3,872,572 issued Mar. 25, 1975, Leger U.S. Pat. No. 2,421,339 issued May 27, 1947, and Stevens U.S. Pat. No. 1,418,683 issued June 6, 1922. A variety of rubber or plastic handles for knives or similar implements are widely known. See, for example, Cope U.S. Pat. No. 4,330,937 issued May 25, 1982, Heim U.S. Pat. No. 3,266,081 issued Aug. 16, 1966, and Moritsch U.S. Pat. No. 4,327,465 issued May 4, 1982. Such handles may have rows of yieldably gripping flaps (ribs) thereon. See Smith U.S. Pat. No. 4,452,289, issued June 5, 1984.

The blade portion of known fillet knives is somewhat flexible, a feature which facilitates filleting meat. However, the handle portion of such knives is generally inflexible. Typically, the handle is made of a tough, inflexible rubber or plastic, or the metal tang is thick and inflexible, or both. Such prior art knives allow no flexing action in the handle, and the flexible blade thus tends to break off at the juncture between the handle and blade.

The present invention provides an improved fillet knife having a substantially flexible tang and handle assembly.

SUMMARY OF THE INVENTION

The knife according to the invention includes a blade having a tang and a handle disposed around the tang. The tang has a series of spaced-apart flex sites which enhance resilient flexing of the tang at locations along the length thereof. In combination therewith, the handle is made of a material sufficiently flexible to allow the handle to flex in unison with the tang of the blade. A knife having these features can flex resiliently along its entire length; flexing is not limited to the part of the blade which protrudes from the handle.

According to another aspect of the invention, the handle of a knife according to the invention is formed so that the "feel" of the handle in a user's hand varies. When the handle is made of a resilient rubbery material, the distance between the surface of the handle at any given point and the nearest edge of the tang embedded therein generally determines the "feel" of the handle at that location. The greater this distance is, the softer, i.e. more yielding and resilient, the feel of the handle becomes. A knife according to this aspect of the invention has a finger gripping bottom portion having a softer feel than the top portion of the knife opposing it.

BRIEF DESCRIPTION OF THE DRAWING

A preferred exemplary embodiment of the present invention will hereinafter be described in conjunction with the appended drawing, wherein like numerals denote like elements, and.

DETAILED DESCRIPTION OF A PREFERRED EXEMPLARY EMBODIMENT

Figure 1:
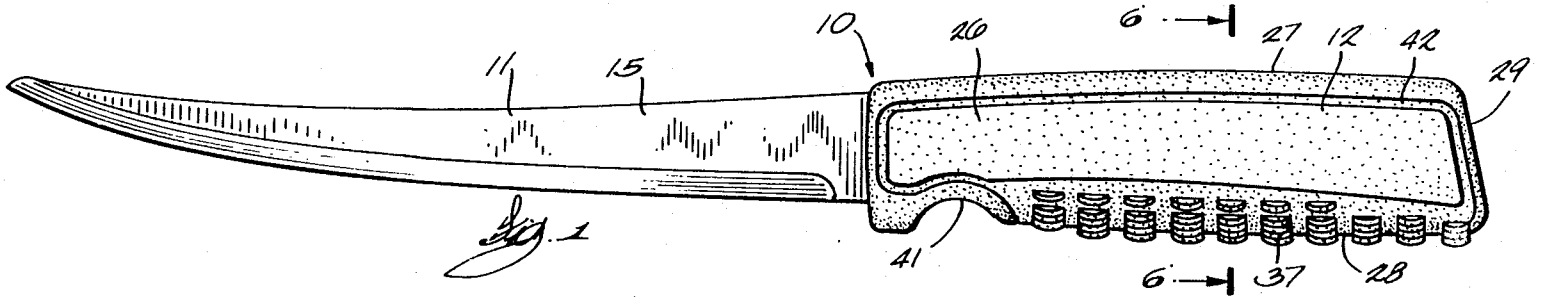
FIG. 1 is side, elevational view of a knife according to the present invention.
Figure 2:
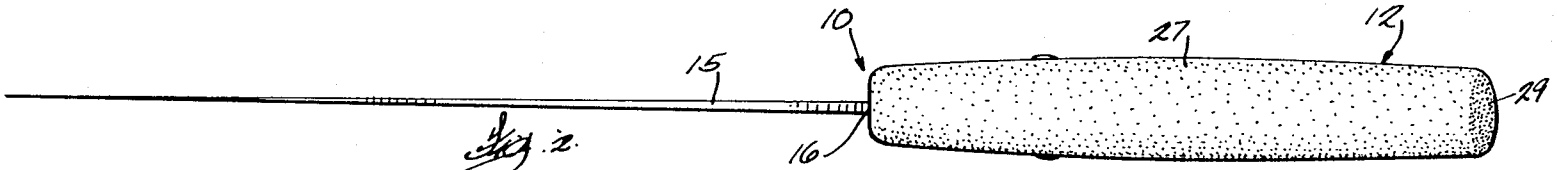
FIG. 2 is a top, plan view of the knife shown in FIG. 1.
Figure 3:
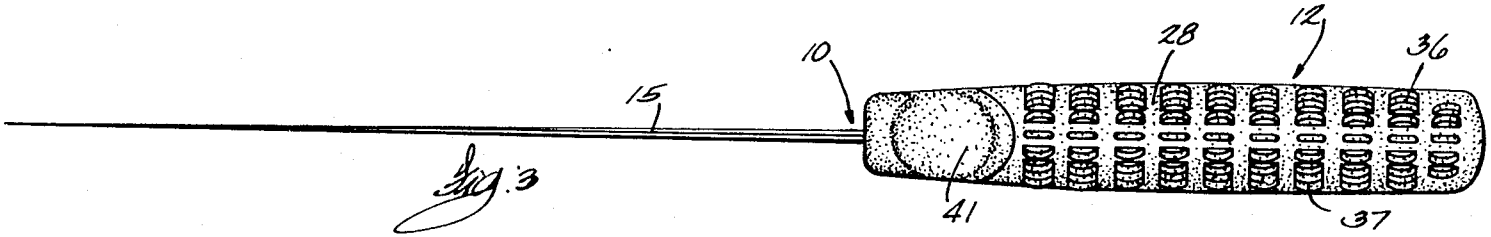
FIG. 3 is a bottom, plan view of the knife shown in FIG. 1.

FIGS. 1 through 7 illustrate a fillet knife 10 according to the invention comprising a unitary steel blade blank 11 and a rubber handle 12. Blade blank 11 includes a blade 15 and a tang 13 having a series of holes 14 therein, which tang 13 is embedded in handle 12.

The front portion of blade blank 11, i.e. blade 15 which protrudes from handle 12, is of conventional design. Blade blank 11, including tang 13, is elongated and generally flat, and is preferably made of a hardenable stainless steel, such as AISI 410 alloy. Blade 15 according to the present invention preferably has a hardness in the range of from 54 to 57 RC, particularly 56–57 RC. Blades having a hardness below 54 RC are generally too soft to retain a sharp edge, and blades having a hardness greater than 57 RC are usually too hard, and may crack or fracture due to excessive brittleness.

The dimensions of blade blank 11 must allow sufficient flexibility for good filleting action. Excessively thin blades are limp and do not provide sufficient control when the knife is used to cut through meat. An excessively thick blade is too stiff to flex under typical hand pressures. Blade blank 11 thus usually has an average thickness in the range of from 0.035 to 0.055 inch, most preferably in the range of from about 0.040 to 0.047 inch. The length of blade 15 is in the range of about 6 to 7-½ inches for a fillet knife. The width of blade 15 varies, since the blade tapers to a point. A width in the range of 0.70 to 0.80 inch at base 16 of blade 15 is typical. The average width for a 6-inch blade 15 is about 0.38 inches, and may vary in the range of from 0.30 to 0.45 inches. As referred to herein, an average dimension or distance means an approximate numerical average of measured values for that dimension or distance along the entirety of the part of the knife affected, e.g. the average of tang width along its entire length. A blade having the foregoing characteristics is preferred for use in the present invention, but it must be recognized that blades of other types and configurations are also useful.

Figure 6:
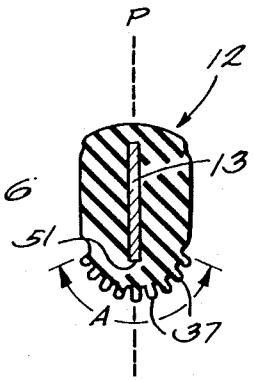
FIG. 6 is a sectional view taken along the line 6—6 in FIG. 1.

The flexing of blade 15 occurs laterally, i.e. in a direction perpendicular to the plane P in which blade blank 11 generally lies (see FIG. 6). The overall flex of blade blank 11 in this direction is calculated according to known methods. The average width W of tang 13 is generally slightly less, e.g. at least 0.01 inch less, than the corresonding width of base 16 of blade 15 to allow for the additional stiffness of the handle material surrounding tang 13, i.e. so that the handle and tang will have comparable flexing characteristics to the blade.

Holes 14 define a series of flex sites 21 located at regular intervals along the length of tang 13. Flex sites 21 preferably comprise portions of tang 13 wherein the total cross-sectional area thereof is reduced, e.g. by the presence of holes 14, so that tang 13 has increased flexibility at sites 21. In the illustrated embodiment (see FIG. 7) pairs of flex sites 21 comprise side portions of tang 13 on opposite sides of each hole 14. Holes 14 are spaced apart to provide flexing action which accommodates the grip of the human hand. The centers of holes 14, which correspond to the centers of the associated pair of flex sites 21, are accordingly spaced apart at intervals in the range of from about 0.38 to 0.75 inch. There are between four and eight such pairs of flex sites 21 and corresponding holes 14, most preferably five or six such holes 14 and pairs of flex sites 21. Pairs of flex sites 21 are preferably spaced at regular intervals, forwardly from the rear of tang 13.

A front portion 22 of tang 13 is preferably free of holes 14, i.e. flex sites 21. Front portion 22 spans base 16 of blade 15 and a forwardmost hole 14A. This front portion 22 represents the transition from blade to handle and is subject to greater bending and shear stresses than any other portion of blade blank 11. Flex sites 21 disposed in this location would increase stresses to the level of blade fracture. For a tang at least about 0.5 inch wide on the average, hole 14A should therefore be located at least about one inch from base 16 of blade 15. Transition portion 22 of tang 13 generally has a length in the range of from 1 to 3 inches, more particularly 1.5 to 2 inches. These ranges will vary for other types of knives having different blade thicknesses. In general, however, the length of transition portion 22 should be greater than the average spacing between adjacent flex sites, most preferably at least about 1.5 times the latter distance, illustrated in FIG. 7 as the distance D between the centers of adjoining holes 14.

Figure 7:
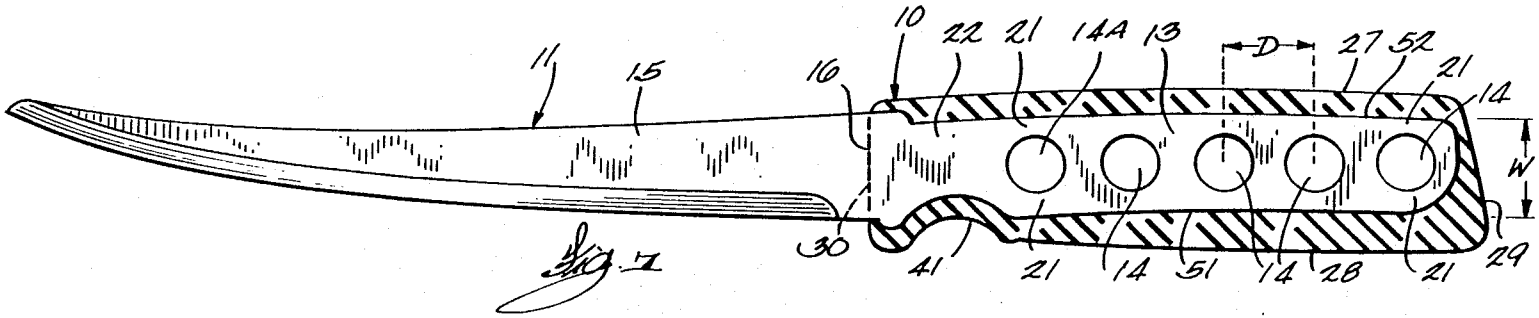
FIG. 7 is a side, elevational view as shown in FIG. 1, with the handle partially broken away.

At the center of each flex site 21 as shown in FIG. 7, holes 14 have a diameter of at least about 50% of the average width W of tang 13, most preferably in the range of 50% to 60% of the width W. If holes 14 are too small, flexing at sites 21 is insufficient. If holes 14 are too large relative to width W of tang 13, flex sites 21 become weak and tend to break under strain. Holes 14 also serve to mechanically interlock handle 12 with tang 13 because the material of handle 12 fills holes 14 as handle 12 is molded. Prior art knives wherein the tang has a series of holes therethrough achieve such mechanical interlocking, or secure the handle to the tang in combination with a rivet or other fastener, but fail to provide flex sites 21.

FIGS. 1 through 6 illustrate the external features of handle 12 according to the invention. Handle 12 is a unitary piece of rubber of similar elastomeric material, such as PVC (polyvinyl chloride). The hardness of such material is selected so that handle 12 has the proper degree of flexibility matching that of blade 15 and tang 13. If the material is too hard, handle 12 loses the desired flexibility and comfortable feel. If the material is too soft, handle 12 becomes difficult to control when the knife is in use. Accordingly, it is preferred that handle 12 be made of a material having a durometer hardness in range of about 50 to 60, particularly 52–58.

Figure 5:
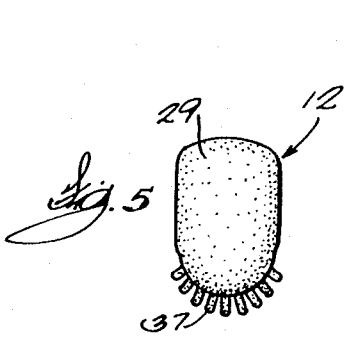
FIG. 5 is a rear view of the knife shown in FIG. 1.
Figure 4:
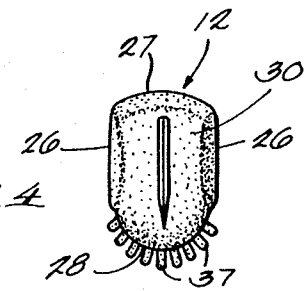
FIG. 4 is a front view of the knife shown in FIG. 1.

Handle 12 has a generally rectangular cross sectional shape as indicated in FIGS. 4 through 6. The exterior surface of handle 12 includes a pair of generally rectangular sides 26, a slightly rounded top 27, a bottom 28, a butt end face 29, and a front face 30. In the illustrated embodiment, opposing sides 26 and top 27 are essentially flat, i.e. are only slightly rounded, whereas bottom 28 is substantially arcuate, usually semicircular. Bottom 28 has a plurality of rows 36 of radially extending ribs (projections) 37 similar to the flaps described in Smith U.S. Pat. No. 4,452,289 noted above, the entire contents of which are hereby incorporated by reference herein. Each row 36 comprises a series of spaced apart ribs 37 made of the same material as the handle and ranged in an arc relative to an approximate lengthwise axis of handle 12. The arc A described by each row 36 generally describes an included angle of from 90 to 180 degrees, preferably 135 to 180 degrees.

Each rib 37 comprises a slightly rounded, generally rectangular projection elongated in the lengthwise direction of the knife. Each rib 37 has a length in the range of about ⅛ to ¼ inch. Ribs 37 are positioned on bottom 28 of the knife where the fingers wrap around the knife. Each rib 37 is flexible, but has sufficient stiffness to enhance the gripping characteristics of handle 12.

When handle 12 is made of the above-mentioned elastomeric material, the height and width of each rib 37 determine the degree of flexibility of each rib 37. In general, the ratio of the height to the width of each rib is approximately in the range 1:1 to 1.75:1, preferably 1.3:1 to 1.5:1. Excessively flexible ribs tend to yield too much and fail to enhance the gripping characteristics of handle 12. Excessively inflexible ribs 37 are uncomfortable. Rows 36 of ribs 37 are parallel and are spaced apart, generally by a distance less than half the length of each rib 37. Rows 36 preferably span a major part of the length of bottom 28 of handle 12. The portion of bottom 28 corresponding to front portion 22 of handle 12 generally has a rounded forefinger indentation 41. Rows 36 of ribs 37 are arranged along bottom 28 rearwardly from indentation 41 back to butt surface 29. Corresponding ribs 37 in each row 36 are aligned to define a series of lengthwise, linear rows of ribs 37. Continuous lengthwise splines could be employed in lieu of ribs 37 by effectively filling the spaces between adjacent ends of each rib 37. However, the use of individual ribs 37 is preferred since such ribs provide greater gripping capability.

Top 27 of handle 12 is generally featureless, but may include a roughened thumb grip portion (not shown) opposite indentation 41. Sides 26 can include a decorative indentation 42.

The feel of handle 12, i.e. the way it yields when held, depends to a large extent on the amount of handle material between the nearest edge or face of tang 13 and the associated outer face of handle 12. For a handle made of an elastomeric material having a 50–60 durometer, the following distances between the outer surface of handle 12 and the nearest associated edge or face of tang 13 determine the firmness of the handle at that location:

| "Feel" of Handle | Distance (inches) |
|---|---|
| soft | 0.20 or more |
| semi-soft | 0.18–0.20 |
| firm | 0.15–0.18 |
| semi-hard | 0.12–0.15 |
| hard | 0.12 or less |

Bottom 28 of handle 12 preferably has a soft feel to provide a good grip, and thus the surface thereof should be at least 0.2 inches, on average, from bottom edge 51 of tang 13. Top 27 preferably has a firm feel to aid the user in exerting cutting pressure, and thus the average distance between upper edge 52 of tang 13 and the exterior surface of top 27 is not greater than about 0.18 inch, preferably in the range of from 0.15 to 0.18 inch. Sides 26 may have any desired feel, such as a soft or semi-soft feel, and are dimensioned accordingly.

Knife 10 constructed according to the preceding embodiment thus has a firm yet comfortable grip, and can flex substantially along the entire length thereof in use. When flexed, knife 10 can assume an arc-shaped configuration such that the tip of blade 15 can be deflected as much as 10 degrees, particularly 20 degrees or more relative to the lengthwise axis of the knife in its original position. The foregoing embodiment of a fillet knife according to the invention thus provides improved flexibility together with improved gripping and handling characteristics in the handle.

It will be understood that the above description is of preferred exemplary embodiments of the invention, and that the invention is not limited to the specific forms shown. For example, pairs of indentations in edges 51, 52 of tang 13 could be used in place of holes 14 to provide central flex sites 21. Flex sites 21 could also comprise a series of spaced-apart portions of tang 13 of reduced thickness, or could be provided by varying the alloy of tang 13 to provide greater flexibiity at flex sites 21. These and other modifications may be made in the design and arrangement of the elements without departing from the scope of the present invention as expressed in the appended claims.

We claim:

1. A knife including an elongated, generally flat, flexible blade having a tang and an elongated handle disposed on said tang, improved in that:

said tang has a plurality of spaced-apart flex sites allowing resilient flexing of said tang at a series of locations along the length thereof; and said handle is made of a material sufficiently flexible to allow said handle to flex in unison with said tang, upon application of a bending force, such that said knife can when flexed assume a generally arc-shaped configuration along substantially its entire length and resiliently return to its original shape upon release of the bending force.

2. The knife of claim 1, wherein said tang has a series of holes extending therethrough spaced-apart along the lengthwise direction thereof, and said flex sites comprise portions of said tang adjoining said holes at diametrically opposed positions in the widthwise direction of said tang.

3. The knife of claim 2, wherein said tang has at least four of said holes, and said holes are spaced-apart at approximately regular intervals along the lengthwise direction of said tang.

4. The knife of claim 3, wherein said holes extend, in the widthwise direction of said tang, at least about 50 percent of the total width of said tang proximate said holes.

5. The knife of claim 4, wherein said holes are circular and are generally aligned in the lengthwise direction of said tang.

6. The knife of claim 3, wherein said handle material extends through said holes and unites said handle to said tang.

7. The knife of claim 1, wherein said handle can bend at said flex sites to assume a generally arcuate configuration from an initial, straight position.

8. The knife of claim 1, wherein said handle is made of an elastomeric material having a durometer in the range of from 50 to 60.

9. The knife of claim 8, wherein said handle has a pair of opposing, substantially flat side faces, a top face, and a substantially arcuate bottom face having a series of parallel, arcuate rows of resilient ribs thereon, which rows are spaced-apart along the lengthwise direction of said handle.

10. The knife of claim 9, wherein each of said rows of ribs describes an arc defining an included angle in the range of about 145 to about 180 degrees.

11. The knife of claim 8, wherein said handle has a pair of substantially flat side faces in opposing positions, and opposing top and bottom faces spanning said side faces, said tang is substantially flat and aligned parallel to said side faces, said tang having respective top and bottom edges proximate said top and bottom faces of said handle, respectively, the average distance between the outer surface of said top face and said top edge of said tang being less than the average distance between the outer surface of said bottom face of said handle and said bottom edge of said tang.

12. The knife of claim 11, wherein said average distance between said outer surface of said bottom face of said handle and said bottom edge of said tang is at least about 0.2 inches, and said average distance between said outer surface of said top face of said handle and said top edge of said tang is in the range of about 0.15 to about 0.18 inch.

13. A knife comprising:

an elongated, unitary, generally flat, flexible metal blade blank including a blade and a tang, said tang having a series of spaced-apart holes extending through the thickness thereof and a front tang portion free of said holes between said blade and a forwardmost one of said holes, said front tang portion extending in the lengthwise direction of said tang a distance at least about 1.5 times the average distance between centers of adjacent holes, said holes extending in the widthwise direction of said tang a distance at least half of the width of said tang proximate each respective holes, said tang having enhanced flexibility at flex sites thereof on opposite lateral sides of said holes; and a flexible elastomeric handle surrounding said tang and extending through said holes to interlock said blade blank and said handle, said handle having a durometer in the range of 50 to 60, such that said handle and said tang can flex in unison, said knife can assume a generally arc-shaped configuration along substantially its entire length, and the tip of said blade can deflect at least about ten degrees relative to the lengthwise axis of said knife when said knife is flexed in said arc-shaped configuration.

14. The knife of claim 13, wherein said handle has a pair of generally flat side faces on opposite sides thereof, a top face spanning said side faces, and an arcuate bottom face spanning said side faces, said bottom face having a series of parallel rows of flexible, spaced-apart ribs thereon, each of which ribs extend generally radially outwardly relative to the lengthwise axis of said handle, each of said rows of ribs lying in an imaginary plane perpendicular to the lengthwise direction of said handle.

15. A knife, comprising:

an elongated, unitary, generally flat, flexible metal blade blank including a blade and a tang, said tang having a series of spaced apart holes extending through the thickness thereof and a front tang portion free of said holes between said blade and a forwardmost one of said holes, said front tang portion extending in the lengthwise direction of said tang a distance at least about 1.5 times the average distance between centers of adjacent holes, said holes extending in the widthwise direction of said tang a distance at least half of the width of said tang proximate each respective hole, said tang having enhanced flexibility at flex sites thereof on opposite lateral sides of said holes;

a flexible elastomeric handle having a durometer in the range of 50 to 60 surrounding said tang and extending through said holes to interlock said blade blank and said handle, such that said handle and said tang can flex in unions, said knife can assume a generally arc-shaped configuration along its entire length, and the top of said knife is capable of being deflected at least about twenty degrees relative to the lengthwise axis of said knife when said knife is flexed in said arc-shaped configuration, said handle having a pair of substantially flat side faces in opposing positions, and opposing top and bottom faces spanning said side faces; and said tang is aligned generally parallel to said side faces and has respective top and bottom edges proximate said top and bottom faces of said handle, respectively, the average distance between the outer surface of said top face and said top edge of said tang is in the range of about 0.15 to about 0.18 inch, and the average distance between the outer surface of said bottom face of said handle and said bottom edge of said tang is at least about 0.2 inch.

* * * * *